US011739988B2

(12) United States Patent
Rahhal

(10) Patent No.: US 11,739,988 B2
(45) Date of Patent: Aug. 29, 2023

(54) FLOODED EVAPORATOR

(71) Applicant: Carrier Corporation, Palm Beach Gardens, FL (US)

(72) Inventor: Charbel Rahhal, Lyons (FR)

(73) Assignee: CARRIER CORPORATION, Palm Beach Gardens, FL (US)

( * ) Notice: Subject to any disclaimer, the term of this patent is extended or adjusted under 35 U.S.C. 154(b) by 331 days.

(21) Appl. No.: 17/109,945

(22) Filed: Dec. 2, 2020

(65) Prior Publication Data

US 2021/0164699 A1 Jun. 3, 2021

(30) Foreign Application Priority Data

Dec. 3, 2019 (EP) ..... 19306557

(51) Int. Cl.
*F25B 39/02* (2006.01)
*F25B 5/02* (2006.01)
*F25B 40/02* (2006.01)

(52) U.S. Cl.
CPC ..... *F25B 5/02* (2013.01); *F25B 39/028* (2013.01); *F25B 40/02* (2013.01); *F25B 2339/02* (2013.01)

(58) Field of Classification Search
CPC ..... F25B 5/02; F25B 39/028; F25B 39/024; F25B 39/022; F25B 40/02; F25B 2339/02; F25B 2339/021; F25B 2339/022; F25B 2339/024; F25B 2339/0241; F25B 2339/0242; F28D 3/02; F28D 3/04; F28D 5/02; F28D 21/0017; F28F 9/00; F28F 9/0202; F28F 9/0204; F28F 9/0214;

(Continued)

(56) References Cited

U.S. PATENT DOCUMENTS 5,704,422 A 1/1998 Chess et al.
8,833,437 B2 9/2014 Singh et al.
8,944,152 B2 2/2015 Kulankara et al.
(Continued)

FOREIGN PATENT DOCUMENTS

CN 202024538 U 11/2011
CN 203533991 U 4/2014
(Continued)

OTHER PUBLICATIONS

European Search Report for Application No. 19306557.0; dated Jun. 17, 2020; 7 Pages.

*Primary Examiner* — Miguel A Diaz
(74) *Attorney, Agent, or Firm* — CANTOR COLBURN LLP

(57) ABSTRACT

An evaporator system includes an evaporator chamber 28 having one or more heat exchanger tubes 4 passing therethrough for transmitting a fluid to be cooled through the evaporator chamber 28; and a refrigerant separator configured to separate a two-phase refrigerant into refrigerant vapour and liquid refrigerant, and having a first outlet 32 for the separated vapour refrigerant and a second outlet 30 for the separated liquid refrigerant; the first outlet 32 is arranged for supplying the vapour refrigerant into the evaporator chamber 28 at a location above at least some of the heat exchanger tubes 4, and the second outlet 30 is arranged for supplying the liquid refrigerant into the evaporator chamber 28 at a location below at least some of the heat exchanger tubes 4.

14 Claims, 2 Drawing Sheets

(58) Field of Classification Search
CPC ..... F28F 9/0217; F28F 9/0231; F28F 9/026; F28F 9/0265; F28F 9/0278
See application file for complete search history.

(56) References Cited

U.S. PATENT DOCUMENTS

| | | | | |
|---|---|---|---|---|
| 2016/0040917 | A1 | 2/2016 | Liu et al. | |
| 2017/0153061 | A1 | 6/2017 | Yoshioka et al. | |
| 2018/0224172 | A1* | 8/2018 | Moreaux | F25B 39/04 |
| 2018/0335234 | A1* | 11/2018 | Stamp | F28F 9/0273 |
| 2022/0178595 | A1* | 6/2022 | Terai | F25B 39/028 |

FOREIGN PATENT DOCUMENTS

| | | | |
|---|---|---|---|
| CN | 104819604 | A | 8/2015 |
| CN | 104819605 | A | 8/2015 |
| EP | 1518077 | B1 | 3/2005 |
| EP | 2649396 | B1 | 2/2017 |
| FR | 2096853 | A1 | 3/1972 |
| GB | 622043 | A | 4/1949 |
| JP | 54108957 | A | 8/1979 |
| JP | H08233407 | A | 9/1996 |
| JP | 3351001 | B2 | 11/2002 |
| JP | 3360343 | B2 | 12/2002 |
| WO | 2013162758 | A1 | 10/2013 |
| WO | 2017151626 | A1 | 9/2017 |

* cited by examiner

FLOODED EVAPORATOR

FOREIGN PRIORITY

This application claims priority to European Patent Application No. 19306557.0, filed Dec. 3, 2019, and all the benefits accruing therefrom under 35 U.S.C. § 119, the contents of which in its entirety are herein incorporated by reference.

TECHNICAL FIELD

The present disclosure relates generally to flooded evaporators that flood the evaporator shell with refrigerant so as to cool heat-exchanger tubes arranged within the shell and thereby cool fluid passing through the tubes.

BACKGROUND

Most common evaporators for cooling fluids are either falling film evaporators or flooded evaporators. These evaporators comprise a shell that defines a hollow chamber therein, through which heat exchanger tubes extend. A relatively hot fluid that is desired to be cooled is passed through the heat exchanger tubes, whilst a refrigerant is supplied to the outside of the tubes. The heat from the heat exchanger tubes vaporises the refrigerant, which removes heat from the tubes and hence cools the fluid passing therethrough.

In falling film evaporators, the refrigerant is supplied into the upper region of the shell, above the heat exchanger tubes, such that the vapour phase refrigerant passes up and out of the shell (to the compressor), whereas the liquid refrigerant is sprayed uniformly down over the heat-exchanger tubes.

In contrast, in flooded evaporators the refrigerant is conventionally supplied to the bottom of the shell, below the heat exchanger tubes. As the refrigerant that is supplied is both in liquid and vapour phase, this presents various challenges, such as how to uniformly distribute the liquid refrigerant to the heat exchanger tubes. Also, the refrigerant vapour that is in the refrigerant supplied to the shell tends to block the liquid refrigerant from contacting the heat exchanger tubes, thereby lowering the efficiency of the evaporator.

SUMMARY

The present disclosure provides an evaporator system comprising: an evaporator shell having a partitioning wall therein that divides the shell into an evaporator chamber and a refrigerant receiving chamber for receiving a two-phase refrigerant, wherein the evaporator chamber has one or more heat exchanger tubes passing therethrough for transmitting a fluid to be cooled through the evaporator chamber; and a refrigerant separator comprising said refrigerant receiving chamber and configured to separate the two-phase refrigerant into refrigerant vapour and liquid refrigerant, the refrigerant separator having a first outlet for the separated vapour refrigerant and a second outlet for the separated liquid refrigerant; wherein the first outlet is arranged for supplying the vapour refrigerant into the evaporator chamber at a location above at least some of the heat exchanger tubes, and wherein the second outlet is arranged for supplying the liquid refrigerant into the evaporator chamber at a location below at least some of the heat exchanger tubes.

The evaporator chamber having the one or more heat exchanger tubes is a flooded evaporator.

The refrigerant separator comprises the refrigerant receiving chamber and an inlet for receiving the two-phase refrigerant; wherein the second outlet for the liquid refrigerant may be arranged below the inlet and/or wherein the first outlet for the refrigerant vapour may be arranged above the inlet.

Said second outlet may comprise one or more first apertures arranged through a lower or bottom portion of the partitioning wall, or arranged between the bottom of the partitioning wall and the shell, for allowing liquid refrigerant to pass from the refrigerant receiving chamber to the evaporator chamber at a location below at least some of the heat exchanger tubes.

The partitioning wall within the shell may be substantially vertical. However, it is contemplated that the partitioning wall need not be vertical.

The one or more first apertures may be a slotted aperture.

The one or more first apertures may be a slotted aperture that is elongated in the same direction as a longitudinal axis of the one or more heat exchanger tubes.

Each of the one or more slotted apertures may have a length in the direction that it is elongated which corresponds to at least x % of the length of the one or more heat exchanger tubes, wherein x is selected from: 20; 25; 30; 35; 40; 45; 50; 55; 60; 65; 70; 75; 80; 85 or 90.

Such relatively large apertures provide a low, or no, pressure drop between the refrigerant receiving chamber and the evaporator chamber. Such relatively long apertures also enable the liquid refrigerant to easily flow over the length of the heat exchanger tube(s).

The refrigerant separator may comprise an inlet into the refrigerant receiving chamber for receiving the two-phase refrigerant, wherein the second outlet for the separated liquid refrigerant is arranged below the inlet.

The evaporator system may comprise a baffle arranged between the inlet and the second outlet for preventing turbulent flow of liquid refrigerant from the inlet to the one or more first apertures.

The baffle may extend from the partitioning wall.

The refrigerant separator may comprise an inlet into the refrigerant receiving chamber for receiving the two-phase refrigerant, wherein the first outlet for the separated vapour refrigerant arranged above the inlet.

Said first outlet for the separated vapour refrigerant may comprise one or more second apertures arranged through an upper portion of the partitioning wall, or arranged between the top of the wall and the shell, for allowing refrigerant vapour to pass from the refrigerant receiving chamber to the evaporator chamber at a location above at least some of the heat exchanger tubes.

The evaporator shell may be a tubular shell that is elongated in a longitudinal direction, wherein the partitioning wall is substantially planar and is arranged in a plane that is defined by the longitudinal direction of the tubular shell and an axis orthogonal to this longitudinal direction.

The longitudinal direction of the shell may be the direction in which the heat exchanger tubes are elongated.

The tubular shell may be a substantially cylindrical shell.

Although the evaporator shell has been described as having a partitioning wall therein that divides the shell into said evaporator chamber and said refrigerant receiving chamber, it is contemplated that the refrigerant receiving chamber (and refrigerant separator) may be outside of the shell. For example, a wall of the evaporator shell may be the partitioning wall between the evaporator chamber and the refrigerant receiving chamber for receiving the two-phase refrigerant (wherein the refrigerant receiving chamber forms part of the refrigerant separator).

Accordingly, the present disclosure also provides an evaporator system comprising: an evaporator shell comprising an evaporator chamber that has one or more heat exchanger tubes passing therethrough for transmitting a fluid to be cooled through the evaporator chamber; and a refrigerant separator comprising a refrigerant receiving chamber configured to separate a two-phase refrigerant into refrigerant vapour and liquid refrigerant, and having a first outlet for the separated vapour refrigerant and a second outlet for the separated liquid refrigerant; wherein the first outlet is arranged for supplying the vapour refrigerant into the evaporator chamber at a location above at least some of the heat exchanger tubes, and wherein the second outlet is arranged for supplying the liquid refrigerant into the evaporator chamber at a location below at least some of the heat exchanger tubes; and wherein a wall of the evaporator shell is a partitioning wall between said evaporator chamber and said refrigerant receiving chamber.

Said second outlet may comprise one or more first apertures arranged through a lower of the partitioning wall for allowing liquid refrigerant to pass from the refrigerant receiving chamber to the evaporator chamber at a location below at least some of the heat exchanger tubes; and/or said first outlet for the separated vapour refrigerant may comprise one or more second apertures arranged through an upper portion of the partitioning wall for allowing refrigerant vapour to pass from the refrigerant receiving chamber to the evaporator chamber at a location above at least some of the heat exchanger tubes.

The present disclosure also provides a method of cooling a fluid comprising: providing an evaporator system as described herein; supplying a fluid to be cooled through the one or more heat exchanger tubes; supplying both a liquid phase and a vapour phase of a refrigerant to the refrigerant separator; separating the vapour phase from the liquid phase within the refrigerant separator; passing the separated vapour phase to the first outlet so as to supply the vapour phase refrigerant into the evaporator chamber at a location above at least some of the heat exchanger tubes; and passing the separated liquid phase to the second outlet so as to supply the liquid phase refrigerant to the evaporator chamber at a location below at least some of the heat exchanger tubes.

The liquid phase refrigerant contacts the one or more heat exchanger tubes within the evaporator chamber and is vaporised by heat from the tubes, thereby removing heat from the one or more heat exchanger tubes and cooling the fluid passing therethrough.

BRIEF DESCRIPTION OF THE DRAWINGS

Various embodiments will now be described, by way of example only, and with reference to the accompanying drawings in which.

DETAILED DESCRIPTION

Figure 1A:
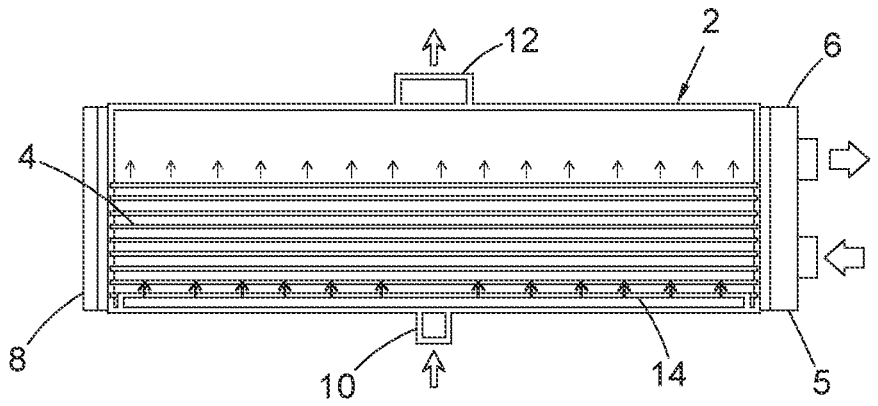
FIGS. 1A-1B show views of a conventional flooded evaporator.
Figure 1B:
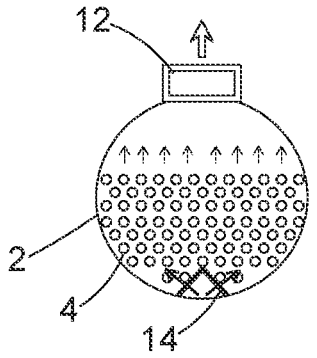

FIGS. 1A-1B show views of a conventional flooded evaporator. More specifically, FIG. 1A shows a cross-sectional view in the plane defined by the longitudinal and radial axes of the evaporator, whereas FIG. 1B shows a cross-sectional view in the plane orthogonal to the longitudinal axis. The evaporator comprises a shell 2 (i.e. housing) that defines a hollow chamber therein. Hollow heat exchanger tubes 4 extend through the shell 2, from a first longitudinal end of the shell to the opposite, second longitudinal end. First and second fluid receiving chambers 5,6 are located at the first longitudinal end of the shell 2 and are arranged in fluid communication with the ends of the heat exchanger tubes 4 arranged at the first longitudinal end. A third fluid receiving chamber 8 is located at the second longitudinal end of the shell 2 and is arranged in fluid communication with the ends of the heat exchanger tubes 4 at the second longitudinal end of the shell. The first chamber 5 has an inlet for receiving a fluid to be cooled and is configured to transmit that fluid into a first subset of the heat-exchanger tubes 4 that is arranged towards the bottom of the shell 2. In use, the fluid passes through the shell 2, within the first subset of the heat-exchanger tubes 4, and into the third fluid chamber 8. The third fluid chamber 8 is configured to transmit the fluid into a second subset of the heat exchanger tubes 4 that is arranged in the upper portion of the shell 2. The fluid then passes through the shell 2, within the second subset of the heat-exchanger tubes 4, and into the second fluid chamber 6. The second fluid chamber has an outlet.

The shell 2 comprises a refrigerant inlet 10 arranged at the bottom of the shell 2 and a refrigerant outlet 12 arranged at the top of the shell. In use, refrigerant is supplied into the shell 2 via the refrigerant inlet 10. The refrigerant inlet 10 is in fluid communication with a refrigerant distributor 14 that extends along the length of the shell 2. The refrigerant distributor 14 has a plurality of holes arranged along the length of the shell 2, such that the refrigerant passes through these holes and is distributed along the length of the shell 2. The refrigerant then comes into contact with the external surfaces of the heat-exchanger tubes 4, where it is heated due to the relatively hot fluid passing through the heat-exchanger tubes 4. This causes the refrigerant to vaporise, and thus removes heat from the heat-exchanger tubes 4 and cools the fluid passing therethrough. The vaporised refrigerant rises and is sucked out of the shell 2, through the refrigerant outlet 12, by a compressor system. The refrigerant is then processed (e.g. by a compressor, condenser and expansion valve) and then supplied back into the bottom of the shell 2 through the refrigerant inlet 10.

In practice, the refrigerant supplied to the refrigerant inlet 10 is a two phase refrigerant, i.e. comprising refrigerant in both liquid and vapour phase. The presence of the refrigerant vapour inhibits contact of the liquid refrigerant with the external surfaces of the heat-exchanger tubes 4, and hence reduces the efficiency of the evaporator. Also, the two-phase refrigerant renders it difficult for the distributor 14 to provide a homogenous refrigerant flow under all operating conditions, since the ratio of vapour refrigerant to liquid refrigerant (and also the total refrigerant flow rate) will change under different operating conditions. It is possible to make the evaporator more efficient by providing the distributor 14 with reduced holes size, but this will cause a large pressure drop across the distributor 14. As such, it is difficult to design the refrigerant distributor 14 to be optimised for all operating conditions, and the design is usually a compromise of competing factors.

Figure 2:
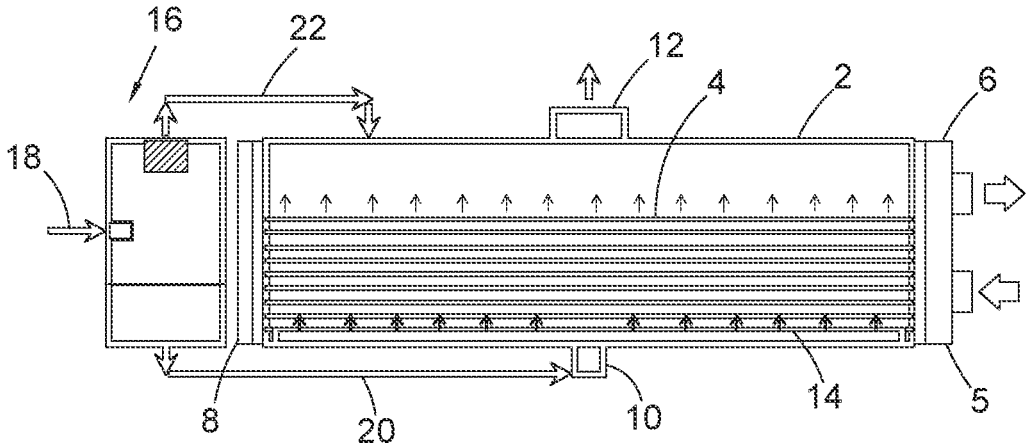
FIG. 2 shows a flooded evaporator that is the same as FIG. 1, except that it has a refrigerant separator located outside of the shell.

FIG. 2 shows a flooded evaporator that is the same as FIG. 1, except that it has a refrigerant separator 16 located outside of the shell 2 for separating the liquid and vapour phases of the refrigerant and supplying them separately into the shell 2. More specifically, the two-phase refrigerant is supplied into the refrigerant separator through an inlet 18, where the liquid phase refrigerant falls under gravity to the bottom of the separator 16, whereas the vapour phase refrigerant rises to an upper region of the separator 16. The liquid phase refrigerant then drains out of the separator 16, through a first conduit 20 to the refrigerant inlet 10 of the evaporator shell 2, and into the refrigerant distributor 14. A circulation pump may be provided to pump the liquid through conduit 20 and into the shell 2. The liquid refrigerant passes through the holes in the refrigerant distributor 14 so as to cool the heat-exchanger tubes 4, in the same manner described in relation to FIG. 1. The gas phase refrigerant passes out of the upper region of the separator 16 and through a second conduit 22 to a gas phase refrigerant inlet located in the top of the shell 2 (or directly to the outlet 12). This gas phase refrigerant then passes through the refrigerant outlet 12, without coming into contact with the heat-exchanger tubes 4. As only liquid refrigerant passes to the refrigerant distributor 14, there is a homogenous flow of liquid refrigerant through the holes of the distributor 14. However, this arrangement is relatively expensive and large due to the external separator 16 and additional conduits 20, 22 etc. that are required.

Figure 3A:
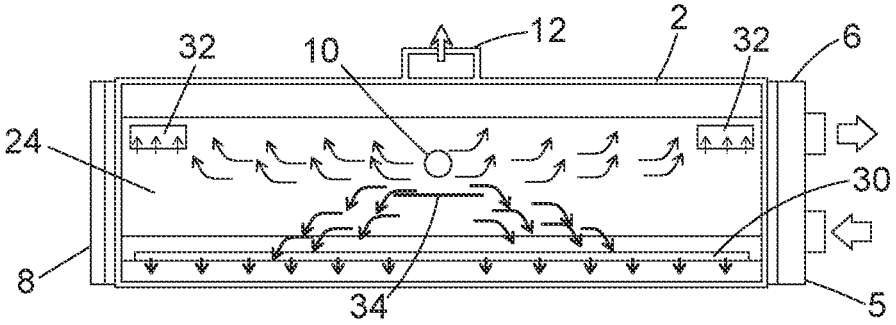
FIGS. 3A-3D show views of three different embodiments of a flooded evaporator according to the present disclosure.
Figure 3B:
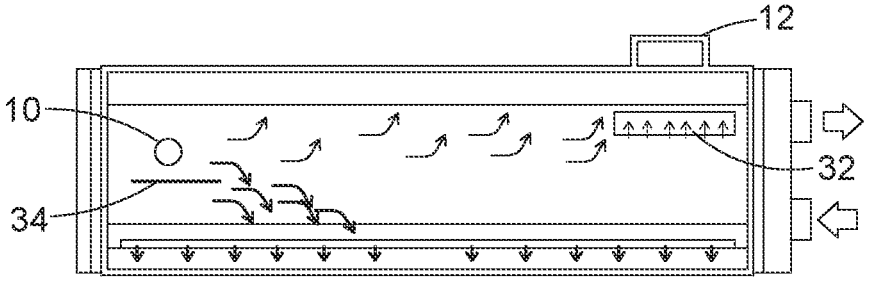
Figure 3C:
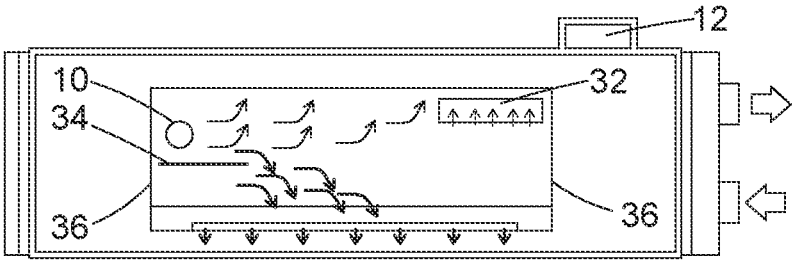
Figure 3D:
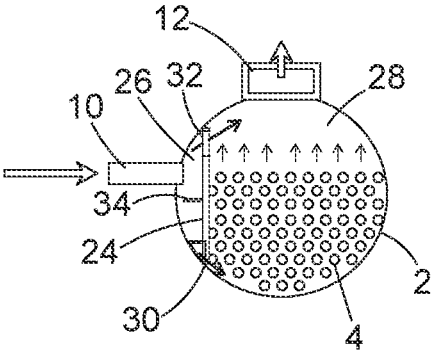

FIGS. 3A-3D show views of three different embodiments of a flooded evaporator according to the present disclosure. More specifically, FIGS. 3A-3C shows cross-sectional views of three different embodiments in the plane defined by the longitudinal and radial axes of each evaporator, whereas FIG. 3D shows a cross-sectional view of each embodiment in the plane orthogonal to the longitudinal axis.

Referring to FIG. 3A, the evaporator comprises a shell 2 (i.e. housing) that defines a hollow chamber therein. Hollow heat exchanger tubes 4 extend through the shell 2, from a first longitudinal end of the shell to the other, second longitudinal end. These tubes are omitted from view in FIGS. 3A-3C, for ease of illustrating other components, but they can be seen in the view of FIG. 3D. First and second fluid receiving chambers 5,6 are located at the first longitudinal end of the shell and are arranged in fluid communication with the ends of the heat exchanger tubes 4 that are located at the first longitudinal end of the shell 2. A third fluid receiving chamber 8 is located at the second longitudinal end of the shell 2 and is arranged in fluid communication with the ends of the heat exchanger tubes 4 located at the second longitudinal end of the shell 2. The first chamber 5 has an inlet for receiving a fluid to be cooled and is configured to transmit that fluid into a first subset of the heat-exchanger tubes that may be arranged in the lower portion of the shell 2. In use, the relatively hot fluid passes through the shell 2, within the first subset of the heat-exchanger tubes, and into the third fluid chamber 8. The third fluid chamber 8 is configured to transmit the fluid into a second subset of the heat exchanger tubes (which are the remaining tubes, other than those in the first subset) that may be arranged in the upper portion of the shell 2. The fluid then passes through the shell 2, within the second subset of the heat-exchanger tubes, and into the second fluid chamber 6. The second fluid chamber 6 has an outlet through which the fluid passes. The fluid may be water or any other fluid. The fluid may pass from the outlet to another system (that heats the fluid), which then recirculates the fluid back to the inlet of first chamber 5.

Although the fluid has been described as being transmitted back and forth along the longitudinal axis of the evaporator twice, through first and second subsets of the heat-exchanger tubes, other configurations are contemplated. The fluid may be transmitted back and forth along the longitudinal axis of the evaporator (through subsets of the heat-exchanger tubes) fewer or greater numbers of times. For example, a fluid inlet may be in communication with the ends of all of the heat-exchanger tubes 2 located at the first longitudinal end of the evaporator, and a fluid outlet may be in communication with the ends of all of the heat-exchanger tubes located at the second longitudinal end of the evaporator.

The shell 2 comprises a refrigerant inlet 10 arranged through a wall of the shell 2, desirably other than through the bottom of the shell 2, as best seen in FIG. 3D. The refrigerant inlet 10 may be in a side wall of the shell 2, such as through a portion other than in the side walls at the longitudinal ends of the shell 2. The shell 2 may be tubular and is desirably cylindrical.

A partitioning wall 24 is provided within the shell 2 so as to divide the shell into a refrigerant receiving chamber 26 and an evaporating chamber 28 arranged on opposing sides of the wall 24. The wall 24 may be secured to the inner surface of the shell 2, e.g. by welding or any other suitable means. The refrigerant inlet 10 is located so as to supply refrigerant into the refrigerant receiving chamber 26, and the heat-exchanger tubes 4 are located in the evaporating chamber 28. A slot 30 is provided through the bottom of the wall 24, or between the bottom of the wall 24 and the inner surface of the shell 2, so as to allow fluid communication between the refrigerant receiving chamber 26 and the evaporating chamber 28. The wall 24 and the slot 30 may extend in a longitudinal direction along the evaporator, and the slot 30 desirably extends over the majority of the length of the wall 24 in the longitudinal direction. Alternatively, rather than a single slot 30, one or more (slotted or non-slotted) apertures may be arranged in the bottom of the wall 24. Where a plurality of such apertures are provided, these may be spaced apart along the longitudinal direction of the wall 24.

One or more apertures 32 is provided through an upper (e.g. top) portion of the wall 24, or between the top of the wall 24 and the inner surface of the shell 2, so as to allow fluid communication between the refrigerant receiving chamber 26 and the evaporating chamber 28. Each of these one or more apertures 32 may be a slot that is elongated in a direction along the longitudinal axis, or each aperture may have another geometry. A baffle member 34 may be provided in the refrigerant receiving chamber 26, located vertically below the refrigerant inlet 10 so as to avoid turbulent flow of the liquid refrigerant to the slot 30 in the bottom of the wall 24. This baffle 34 may extend from the partitioning wall 24 or from the inner surface of the shell 2, e.g. in a horizontal direction. The baffle 34 also extends in a direction part way along the longitudinal axis. A refrigerant outlet 12 may be arranged at the top of the shell 2.

In use, a relatively hot fluid (such as liquid water) is supplied to the inlet of the first chamber 5. This fluid passes through the first subset of the heat-exchanger tubes 4 and into the third fluid chamber 8. These tubes 4, and hence the fluid therein, are cooled by the refrigerant as the fluid passes through the tubes, as will be described below. The fluid then enters the third fluid chamber 8 and is transmitted into the second subset of the heat exchanger tubes 4 arranged in the upper portion of the shell 2. The fluid then passes back through the shell 2, within the second subset of the heat-exchanger tubes, and into the second fluid chamber 6. The fluid is further cooled by the refrigerant as it passes back through the shell 2, as will be described below. The fluid then leaves the second fluid chamber 6 and the evaporator through the fluid outlet. As described above, other configurations of the heat-exchanger tubes 4 are contemplated in which the fluid is passed through the shell 2 only once or greater than twice.

Whilst the fluid is passing through the heat-exchanger tubes 4, refrigerant is supplied to the outside of these tubes so as to cool them, and hence cool the fluid passing through the tubes 4. In order to do this, a two-phase liquid refrigerant (comprising both liquid and vapour state refrigerant) is supplied into the shell 2 via the refrigerant inlet 10. As best seen from FIG. 3D, the two-phase refrigerant passes into the refrigerant receiving chamber 26, where the vapour portion of the refrigerant passes up through the one or more aperture 32 in the upper portion of the wall 24 and into the evaporating chamber 28. As will be described below, this vapour portion of the refrigerant then mixes with the vapour refrigerant that has resulted from the evaporating process in chamber 28. The total refrigerant vapour then passes through the refrigerant outlet 12, e.g. by being sucked out of the shell 2 by a compressor system. The refrigerant vapour then goes through a common cycle and is supplied back to the inlet 10, wherein a portion of the refrigerant is in a liquid phase and another portion is in a vapour phase. For example, the refrigerant vapour is sucked through refrigerant outlet 12 by a compressor system, is then passed through a compressor, a condenser and an expansion valve before being passed back to the inlet 10. The embodiments disclosed herein ensure that the refrigerant vapour entering the refrigerant inlet 10 does not contact the heat-exchanger tubes 4 and so does not inhibit the liquid refrigerant from contacting and cooling the tubes 4.

The liquid portion of the refrigerant passing into the refrigerant receiving chamber 26 from the refrigerant inlet 10 drops under gravity to the bottom of the refrigerant receiving chamber 26. The baffle 34 prevents a turbulent flow of the liquid refrigerant through the slot 30 at the bottom of the wall 24. The liquid refrigerant then passes through the slot 30 and is distributed efficiently into the evaporating chamber 28. The liquid refrigerant then comes into contact with the external surfaces of the heat-exchanger tubes 4, where it is heated due to the relatively hot fluid passing through the heat-exchanger tubes 4. This causes the refrigerant to vaporise, and thus removes heat from the heat-exchanger tubes 4 and cools the fluid passing therethrough. The refrigerant that is vaporised by this process rises up and passes through the refrigerant outlet 12, along with the refrigerant vapour that has passed through the aperture 32 in the upper portion of the wall 24. As described above, the refrigerant vapour then goes through a common cycle and is the resulting refrigerant is supplied back to the inlet 10, wherein a portion of the refrigerant is in a liquid phase and another portion is in a vapour phase.

Although the level of refrigerant in the evaporator chamber 28 is relatively high (in use) so as to contact the heat-exchanger tubes 4, the liquid refrigerant is still able to pass from the refrigerant receiving chamber 26 to the evaporator chamber 28 (through the slot 30) solely under the effect of gravity, even when the level of liquid refrigerant in the refrigerant receiving chamber 26 is relatively low. This is because the refrigerant in the evaporator chamber 28 is boiled by the heat from the heat-exchanger tubes 4 and so although the refrigerant level in the evaporator chamber 28 may be relatively high, this is largely formed of bubbles due to the refrigerant vapour.

In the embodiment shown in FIG. 3A, the refrigerant inlet 10, baffle 34 and refrigerant outlet 12 are located at a longitudinally central position of the evaporator shell 2. Two slotted apertures 32 are provided at the top of the partitioning wall 24 for allowing the refrigerant vapour to pass from the refrigerant receiving chamber 26 into the evaporator chamber 28. The slotted apertures 32 are arranged at opposite longitudinal ends of the wall 24.

The embodiment shown in FIG. 3B is the same as that of FIG. 3A, except that the refrigerant inlet 10 and baffle 34 are located at one longitudinal end of the evaporator shell 2, and only a single slotted aperture 32 is provided that is located at the opposite longitudinal end of the evaporator shell 2. Also, the refrigerant outlet 12 may be located at said opposite longitudinal end of the evaporator shell 2.

The embodiment shown in FIG. 3C is the same as that of FIG. 3B, except that the refrigerant receiving chamber 26 extends only part of the length of the evaporator shell 2. This may be achieved by providing end walls 36 at the longitudinal ends of the refrigerant receiving chamber 26.

Various other embodiments are contemplated. For example, the evaporator may have multiple refrigerant inlets, and optionally multiple refrigerant receiving chambers. For example, two refrigerant receiving chambers may be provided, e.g. refrigerant receiving chambers 26 may be provided on either side of the evaporator chamber 28 when viewed as shown in FIG. 3D. Alternatively, one or more refrigerant receiving chamber 26 may be located at one or each longitudinal end of the evaporator shell.

Additionally, or alternatively, to the multiple refrigerant inlets and/or refrigerant receiving chambers, embodiments are contemplated in which there are provided multiple refrigerant outlets. For example, a refrigerant outlet may be provided at each longitudinal end of the evaporator shell.

It will be appreciated that embodiments described herein allow an optimised flow of liquid refrigerant into and through the evaporator shell 2. For example, the flow of liquid refrigerant is able to be homogenous as the vapour refrigerant is removed from the liquid flow. Embodiments also enable a relatively low total mass flow of the refrigerant to be used, as the refrigerant is used more efficiently by passing substantially only the liquid phase of the refrigerant to the heat exchanger tubes (and not the vapour refrigerant from the refrigerant inlet 10). This improves the efficiency of the heat exchange between the tubes 4 and the refrigerant, as the refrigerant vapour from the refrigerant inlet 10 does not obstruct the liquid refrigerant from contacting the tubes 4. It will also be appreciated that as embodiments house the refrigerant separator chamber 26 inside the evaporator shell 2, the complexity and cost of providing tanks and piping external to the shell is minimised. Furthermore, as a relatively large slot 30 may be provided for allowing liquid refrigerant to pass from the refrigerant receiving chamber 26 to the evaporator chamber 28 (instead of using a complex two-phase refrigerant distributor having small holes), there is a very low (or no) pressure drop across the slot 30. This provides a greater degree of freedom in the choice of refrigerant expansion valve that may be used upstream of the refrigerant inlet 10. The embodiments described herein are also optimised for a wider range of refrigerants, such as lower pressure refrigerants (e.g. R1234ze).

Although the present disclosure has been described with reference to various embodiments, it will be understood by those skilled in the art that various changes in form and detail may be made without departing from the scope of the invention as set forth in the accompanying claims.

For example, it is contemplated that the refrigerant receiving chamber 26 can be fabricated separately and then introduced into the shell 2 during the assembly of the evaporator. The refrigerant receiving chamber 26 can be secured to the shell 2, for example by soldering.

Although the partitioning wall 24 has been described as being within the shell 2 and dividing the shell into a refrigerant receiving chamber 26 and an evaporating chamber 28, it is contemplated that the partitioning wall 24 may instead be an external wall of the shell such that the refrigerant receiving chamber 26 is outside of the shell and the evaporating chamber 28 is inside the shell.

What is claimed is:

1. An evaporator system comprising:

an evaporator shell having a partitioning wall therein that divides the shell into an evaporator chamber and a refrigerant receiving chamber for receiving a two-phase refrigerant, wherein the evaporator chamber has one or more heat exchanger tubes passing therethrough for transmitting a fluid to be cooled through the evaporator chamber; and a refrigerant separator comprising said refrigerant receiving chamber and configured to separate the two-phase refrigerant into refrigerant vapour and liquid refrigerant, the refrigerant separator having a first outlet for the separated vapour refrigerant and a second outlet for the separated liquid refrigerant;

wherein the first outlet is arranged for supplying the vapour refrigerant into the evaporator chamber at a location above at least some of the heat exchanger tubes, and wherein the second outlet is arranged for supplying the liquid refrigerant into the evaporator chamber at a location below at least some of the heat exchanger tubes;

wherein the partitioning wall within the shell is substantially vertical.

2. The evaporator system of claim 1, wherein the one or more first apertures is a slotted aperture that is elongated in the same direction as a longitudinal axis of the one or more heat exchanger tubes.

3. The evaporator system of claim 1, wherein each of the one or more first apertures comprises a slotted has aperture with a length in the direction that it is elongated which corresponds to at least x % of the length of the one or more heat exchanger tubes, wherein x is selected from: 20; 25; 30; 35; 40; 45; 50; 55; 60; 65; 70; 75; 80; 85 or 90.

4. The evaporator system of claim 1, wherein said first outlet for the separated vapour refrigerant comprises one or more apertures arranged through an upper portion of the partitioning wall, or arranged between the top of the wall and the shell, for allowing refrigerant vapour to pass from the refrigerant receiving chamber to the evaporator chamber at a location above at least some of the heat exchanger tubes.

5. The evaporator system of claim 1, wherein said second outlet comprises one or more first apertures arranged through a lower or bottom portion of the partitioning wall, or arranged between the bottom of the partitioning wall and the shell, for allowing liquid refrigerant to pass from the refrigerant receiving chamber to the evaporator chamber at a location below at least some of the heat exchanger tubes.

6. The evaporator system of claim 5, wherein the one or more first apertures is a slotted aperture.

7. The evaporator system of claim 1, wherein the refrigerant separator comprises an inlet into the refrigerant receiving chamber for receiving the two-phase refrigerant, and wherein the second outlet for the separated liquid refrigerant is arranged below the inlet.

8. The evaporator system of claim 7, comprising a baffle arranged between the inlet and the second outlet for preventing turbulent flow of liquid refrigerant from the inlet to the one or more first apertures.

9. The evaporator system of claim 1, wherein the evaporator shell is a tubular shell that is elongated in a longitudinal direction, wherein the partitioning wall is substantially planar and is arranged in a plane that is defined by the longitudinal direction of the tubular shell and an axis orthogonal to this longitudinal direction.

10. The evaporator system of claim 9, wherein the tubular shell is a substantially cylindrical shell.

11. An evaporator system comprising:

an evaporator shell having a partitioning wall therein that divides the shell into an evaporator chamber and a refrigerant receiving chamber for receiving a two-phase refrigerant, wherein the evaporator chamber has one or more heat exchanger tubes passing therethrough for transmitting a fluid to be cooled through the evaporator chamber; and a refrigerant separator comprising said refrigerant receiving chamber and configured to separate the two-phase refrigerant into refrigerant vapour and liquid refrigerant, the refrigerant separator having a first outlet for the separated vapour refrigerant and a second outlet for the separated liquid refrigerant;

wherein the first outlet is arranged for supplying the vapour refrigerant into the evaporator chamber at a location above at least some of the heat exchanger tubes, and wherein the second outlet is arranged for supplying the liquid refrigerant into the evaporator chamber at a location below at least some of the heat exchanger tubes;

wherein the refrigerant separator comprises an inlet into the refrigerant receiving chamber for receiving the two-phase refrigerant, and wherein the first outlet for the separated vapour refrigerant is arranged above the inlet.

12. An evaporator system comprising:

an evaporator shell comprising an evaporator chamber that has one or more heat exchanger tubes passing therethrough for transmitting a fluid to be cooled through the evaporator chamber; and a refrigerant separator comprising a refrigerant receiving chamber configured to separate a two-phase refrigerant into refrigerant vapour and liquid refrigerant, and having a first outlet for the separated vapour refrigerant and a second outlet for the separated liquid refrigerant;

wherein the first outlet is arranged for supplying the vapour refrigerant into the evaporator chamber at a location above at least some of the heat exchanger tubes, and wherein the second outlet is arranged for supplying the liquid refrigerant into the evaporator chamber at a location below at least some of the heat exchanger tubes; and wherein an external wall of the evaporator shell is a partitioning wall between said evaporator chamber and said refrigerant receiving chamber.

13. The evaporator system of claim 12, wherein said second outlet comprises one or more first apertures arranged through a lower of the partitioning wall for allowing liquid refrigerant to pass from the refrigerant receiving chamber to the evaporator chamber at a location below at least some of the heat exchanger tubes; and/or wherein said first outlet for the separated vapour refrigerant comprises one or more second apertures arranged through an upper portion of the partitioning wall for allowing refrigerant vapour to pass from the refrigerant receiving chamber to the evaporator chamber at a location above at least some of the heat exchanger tubes.

14. A method of cooling a fluid comprising:

providing an evaporator system comprising an evaporator shell having a partitioning wall therein that divides the shell into an evaporator chamber and a refrigerant receiving chamber, wherein the evaporator chamber has one or more heat exchanger tubes passing therethrough and a refrigerant separator comprising said refrigerant receiving chamber and first and second outlets;

supplying a fluid to be cooled through the one or more heat exchanger tubes;

supplying both a liquid phase and a vapour phase of a refrigerant to the refrigerant separator;

separating the vapour phase from the liquid phase within the refrigerant separator;

passing the separated vapour phase to the first outlet so as to supply the vapour phase refrigerant into the evaporator chamber at a location above at least some of the heat exchanger tubes; and passing the separated liquid phase to the second outlet so as to supply the liquid phase refrigerant to the evaporator chamber at a location below at least some of the heat exchanger tubes.

* * * * *